US007269270B2

(12) United States Patent
Freeman et al.

(10) Patent No.: US 7,269,270 B2
(45) Date of Patent: Sep. 11, 2007

(54) STANDING WAVE REDUCING

(75) Inventors: Eric J. Freeman, Worcester, MA (US); Timothy Holl, Medway, MA (US)

(73) Assignee: Bose Corporation, Framingham, MA (US)

( * ) Notice: Subject to any disclaimer, the term of this patent is extended or adjusted under 35 U.S.C. 154(b) by 538 days.

(21) Appl. No.: 10/272,705

(22) Filed: Oct. 17, 2002

(65) Prior Publication Data

US 2004/0076304 A1 Apr. 22, 2004

(51) Int. Cl.
*H04R 25/00* (2006.01)

(52) U.S. Cl. ..... 381/346; 381/337; 381/345; 381/349; 381/350; 381/353

(58) Field of Classification Search ..... 381/337, 381/338, 345, 346, 349, 350–354, 165, 160, 381/348; 181/146, 156, 182, 198, 199, 155, 181/145, 181
See application file for complete search history.

(56) References Cited

U.S. PATENT DOCUMENTS 2,295,483 A * 9/1942 Knowles ..... 381/404
3,938,617 A * 2/1976 Forbes ..... 181/155
4,440,259 A * 4/1984 Strohbeen ..... 181/146
4,750,585 A * 6/1988 Collings ..... 181/148
5,012,889 A * 5/1991 Rodgers ..... 181/152
6,275,597 B1 * 8/2001 Roozen et al. ..... 381/345
6,324,292 B1 11/2001 Mitsuhashi et al. ..... 381/349
6,628,799 B2 * 9/2003 Fukuda ..... 381/398

* cited by examiner

*Primary Examiner*—Curtis Kuntz
*Assistant Examiner*—Tuan D. Nguyen
(74) *Attorney, Agent, or Firm*—Fish & Richardson P.C.

(57) ABSTRACT

The frequency at which standing waves occur in a loudspeaker enclosure may be reduced by the addition of an internal barrier to the enclosure in order to lengthen the effective length of an internal dimension of the enclosure. Additionally, the internal barrier may be configured such that it forms a resistive coupling between two sides of the barrier. By configuring the internal barrier to form a resistive coupling, aberrations in the frequency response of the loudspeaker caused by certain standing waves may be dampened.

33 Claims, 2 Drawing Sheets

STANDING WAVE REDUCING

TECHNICAL FIELD

This invention relates to loudspeaker enclosures, and more particularly to the reduction of standing waves within a loudspeaker enclosure.

BACKGROUND

Acoustical drivers, and particularly low frequency drivers such as woofers, may be mounted in an enclosure. Two common types of driver enclosures are sealed enclosures (i.e., not open to a medium of transmission) and ported enclosures (i.e., open to a medium of transmission). The low frequency performance of driver mounted within a sealed enclosure is determined by the internal volume of the enclosure, while the low frequency performance of a driver mounted in a ported enclosure is determined both by the internal volume of the enclosure and the dimensions of the port.

In a rectangular loudspeaker enclosure designed to provide loading to a low frequency drive unit, a standing wave will occur at frequencies related to the interior liner dimensions (e.g, the height, width, length) of the enclosure. Specifically, standing waves will occur at frequencies corresponding to a wavelength equal to twice the linear dimension and multiples of that frequency. For example, if the width of an enclosure is W, standing waves having a wavelength equal to 2W, 2/3W, 2/5W, 2/7W, etc will occur in the enclosure. Standing waves can cause undesirable aberrations in the frequency response of the system. The lowest frequency standing wave occurs along the longest linear dimension (e.g., Jength) of an enclosure and will typically have the most noticeable negative effect on the performance of a loudspeaker.

To illustrate the problem of standing waves within a loudspeaker enclosure, consider the loudspeaker 10 shown in FIG. 1, which includes a ported rectangular enclosure 12 with a driver 14 mounted near one end of the enclosure 16. The internal length of the enclosure has a dimension equal to L. The lowest frequency standing wave will occur at a frequency corresponding with a wavelength equal to twice the effective length of the longest internal dimension of the enclosure (i.e., $\lambda_{sw1}$=2L). Such a standing wave will give rise to a pressure differential within the enclosure at the standing wave frequency, with a high pressure at one end of enclosure 12 and a high pressure at the other end of enclosure 12, where the pressure one end, e.g. end 18, end is out of phase with that of the other end, e.g., end 16. In other words, at a given moment in time, there will be a high negative pressure one end of enclosure 12 and a high positive pressure at the other end of enclosure 12.

In an actual enclosure configured as enclosure 12 depicted in FIG. 1 constructed using 0.5" thick Medium Density Fiberboard (MDF) and having internal dimensions of 13.375" long, 7.5" wide, and 1.75" high, the lowest frequency standing wave occurred at approximately 450 Hz and gave rise to the large aberration in the frequency response shown at point X on trace A in FIG. 2.

One approach to reducing the adverse effects of standing waves in the frequency response range of a loudspeaker is to include acoustically absorbent material (e.g., fiberglass) at one or more strategic locations within the enclosure. However, such an approach is highly dependent on where the material is located (which can be difficult to precisely determine) and the way in which material is packed. The present invention discloses another method of dealing with standing waves.

SUMMARY

In an aspect, the invention features a loudspeaker enclosure for reducing standing waves occurring at a given frequency that includes a barrier having a first side and a second side attached to the inner surface of the enclosure and partially extending into the cavity of the enclosure. The internal barrier is configured to form a resistive coupling between the first and second side and is positioned such that a standing wave at the given frequency would create a significant pressure differential across two sides of the barrier if the barrier was not configured to form a resistive coupling.

Embodiments may include one or more of the following features. The barrier may include one or more holes and damping material, such as foam, may be disposed within one or more of the holes. The holes may be circular or non-circular (e.g., rectangular) in cross-section. The barrier may be formed of porous rigid or flexible material such as rigid, open celled foam or flexible fine-screen mesh. The barrier may also be formed of semi-rigid or slightly flexible material that is non-porous, such as closed-cell foam or slightly flexible plastic. The enclosure may include a plurality of barriers, each configured to form a resistive coupling across the barrier.

In another aspect, an apparatus for reducing standing waves in a loudspeaker includes an enclosure which defines a channel and a resistive coupling attached to the enclosure and located within the channel. The resistive coupling includes a first substantially planar surface and a second substantially planar surface which is substantially parallel to the first substantially planar surface, and has a plurality of holes disposed between the first and second substantially planar surfaces.

Embodiments may include one or more of the following features. The resistive coupling may be positioned at a location which reduces a pressure differential created by a standing wave across the first and second substantially planar surfaces. The resistive coupling may also include damping material such as foam disposed within one or more of the holes. The resistive coupling may also include a third substantially planar surface which is substantially perpendicular to the first and second substantially planar surfaces. The channel defined by the enclosure may have a circular or non-circular cross-sectional shape.

In another aspect, a method for reducing standing waves in the frequency response of a loudspeaker includes increasing the effective length of at least one internal dimension of the enclosure without changing the external dimensions of the enclosure and forming a resistive coupling between two ends of a standing wave.

Embodiments may include one or more of the following features. The step of increasing the effective length of at least one internal dimension may include providing a barrier within the enclosure. The step of forming a resistive coupling between two ends of a standing wave may include providing at least one hole in the barrier and filling one or more holes with damping material. The step of forming a resistive coupling may include providing a barrier formed of material having sufficient porosity to cause viscous damping when air is allowed to pass through the barrier or providing a barrier formed of flexible material sufficient to resistively flex during normal play operations.

The details of one or more embodiments of the invention are set forth in the accompanying drawings and the description below. Other features, objects and advantages will become apparent from the following detailed description when read in connection with the accompanying drawing in which:

DESCRIPTION OF DRAWINGS

Like reference symbols in the various drawings indicate like elements.

DETAILED DESCRIPTION

Standing waves within a driver enclosure occur at frequencies which are dependent upon the effective internal dimensions of the enclosure. By adding internal barriers within the enclosure, the effective dimensions may be increased such that standing waves would occur outside the frequency response of the driver housed by the enclosure.

Figure 1:
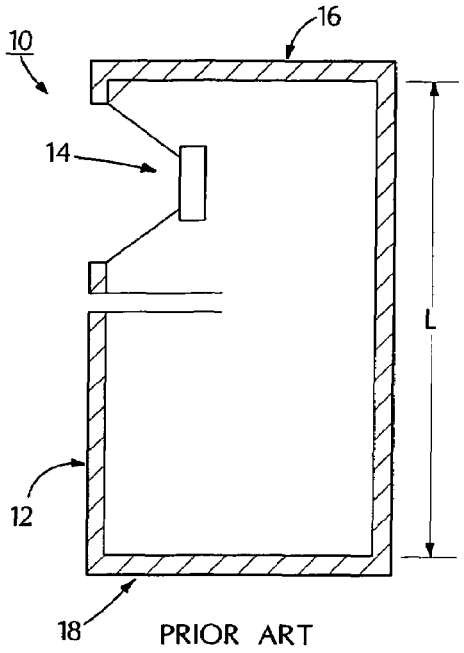
FIG. 1 is a cross-sectional view of a prior art loudspeaker driver and enclosure.
Figure 3:
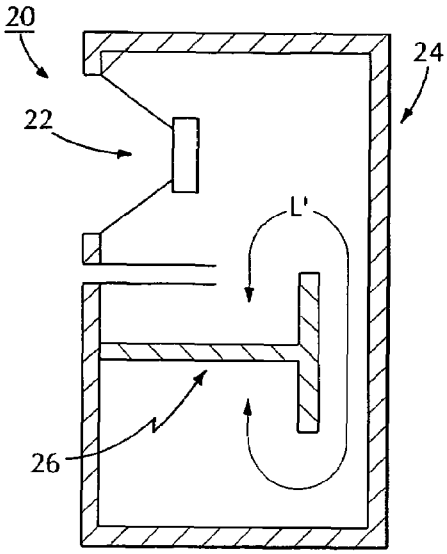
FIG. 3 is a cross-sectional view of a loudspeaker driver and enclosure having an internal barrier.

As shown in FIG. 3, a loudspeaker 20 includes a driver 22 mounted within a ported, rectangular enclosure 24. Enclosure 24 is a rectangular enclosure because it has a rectangular cross-sectional shape along its length. The enclosure 24 includes a barrier 26. In this embodiment, the barrier 26 has a T-shaped cross-section and extends from side to side of the enclosure perpendicular to the plane of the cross-section shown in FIG. 3. Barrier 26 has the effect of increasing the effective length of the longest dimension of the enclosure 22 from L (shown in FIG. 1) to L' (shown in FIG. 3). By increasing the effective length of the enclosure 22, the lowest frequency standing wave will occur at a lower frequency than where the lowest frequency standing wave would occur in an enclosure of the same dimensions without the barrier 26. The addition of the barrier 26 to the enclosure does not substantially alter the total volume of the enclosure, and, therefore, will not substantially alter the low frequency performance of the loudspeaker 20.

Figure 4:
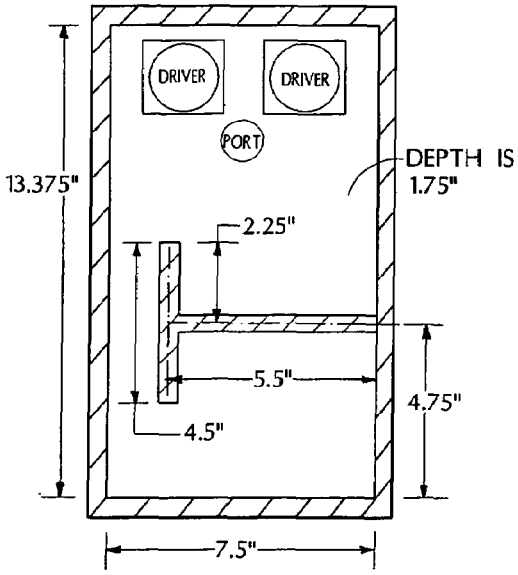
FIG. 4 is a cross-sectional view showing the internal dimensions of an actual loudspeaker enclosure.
Figure 2:
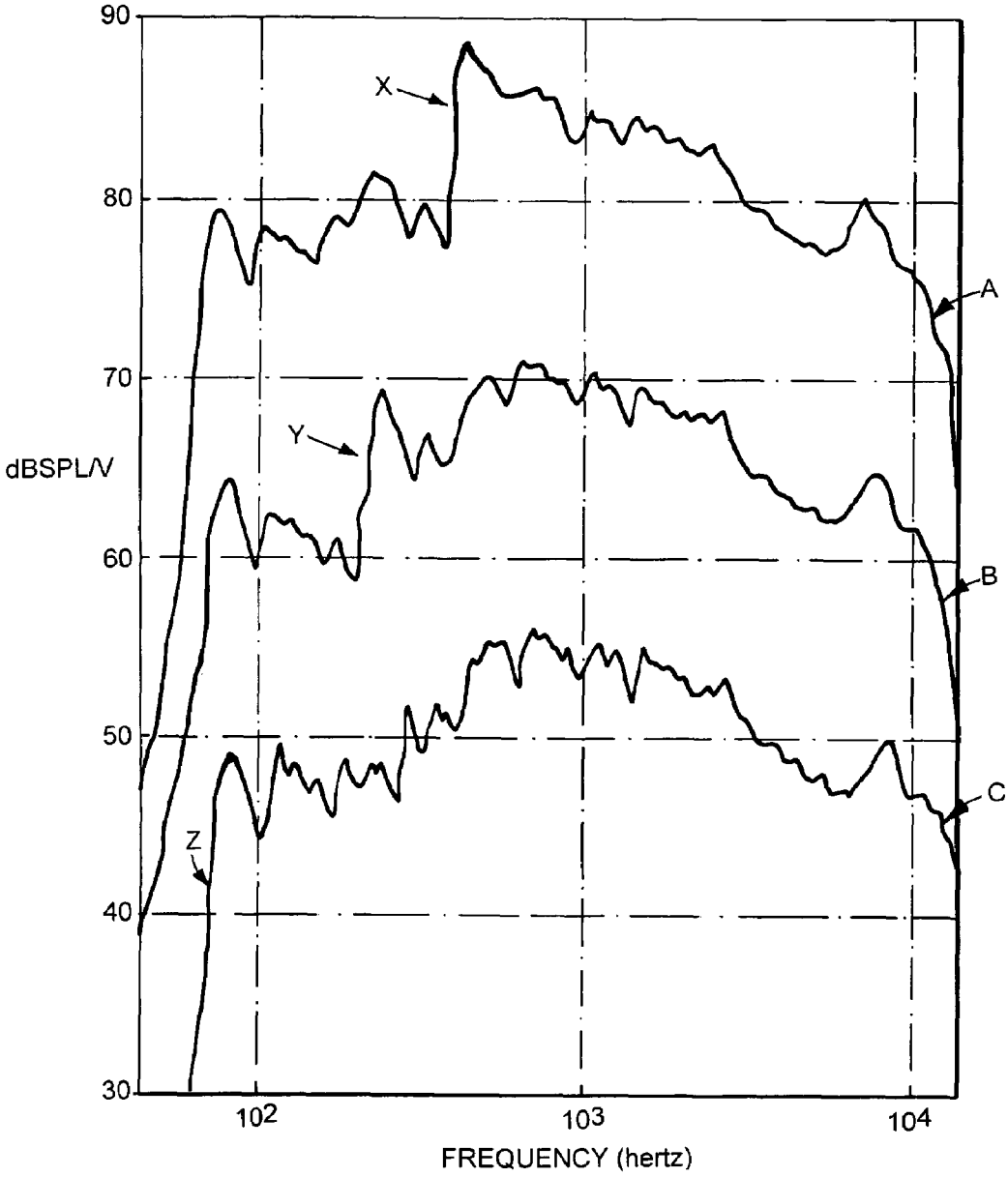
FIG. 2 is a graph depicting the frequency response of three different loudspeakers.

In an actual enclosure constructed of 0.5" MDF and having dimensions as shown in FIG. 4, the lowest frequency standing wave occurred at approximately 240 Hz, which is shown at point Y on trace B in FIG. 2. The same enclosure without internal barrier 26 exhibits the lowest frequency standing wave occurring at approximately 480 Hz as shown at point X on trace A in FIG. 2. Thus, the addition of a barrier reduced the frequency of the lowest standing wave to approximately half of what it was in an enclosure without such a barrier.

Figure 5:
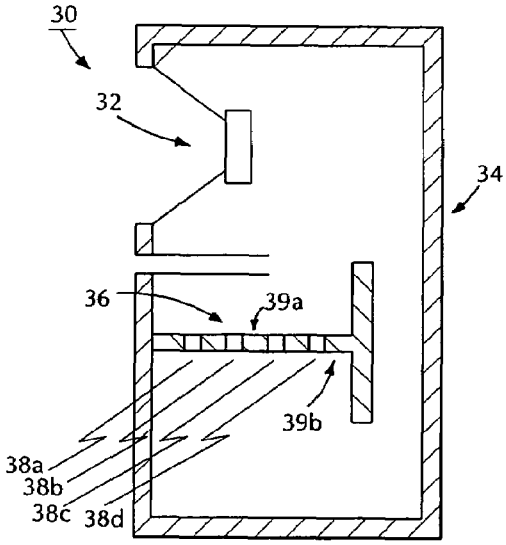
FIG. 5 is a cross-sectional view of a loudspeaker driver and enclosure having an internal barrier which forms a resistive coupling.

As shown in FIG. 5, another loudspeaker 30 includes a driver 32 mounted within a rectangular, ported enclosure 34. The enclosure 34 includes a barrier 36 which has a T-shaped cross-section and extends from side to side of the enclosure 34 perpendicular to the plane of the cross-section shown in FIG. 4. In this embodiment, barrier 36 includes a number of holes 38*a*-38*d* across two sides, 39*a*-39*b*, of the barrier. By adding the holes to the barrier 36, a resistive coupling is formed across the two sides of the barrier, 39*a*-39*b*, having the holes 38*a*-38*d*. The frequency of the lowest standing wave will again shift from the frequency of the lowest standing wave of the enclosure of FIG. 2 due to the change of geometry of the barrier. Additionally, the resulting standing wave will be damped due to the resistive coupling between the two sides of the barrier, 39*a*-39*b*, across which there would be otherwise be a high pressure differential. Careful selection of the number and size of the holes or adding damping material, e.g., foam, within the holes can result in the lowest frequency standing wave being sufficiently damped such that it has no substantial effect on the frequency response of the system.

A resistive coupling may be formed of any material having sufficient rigidity to maintain its general shape during normal play operations and having sufficient porosity to cause viscous (or lossy) damping when there is a pressure differential across the two sides of the barrier and air is allowed to pass through the barrier. For example, in addition to using the rigid barrier with a number of holes as depicted in FIG. 5, a resistive coupling could be formed by fashioning a barrier from such materials as stiff open-cell foam or fine-screen mesh.

Alternatively, a resistive coupling may be formed by a semi-rigid (i.e., slightly flexible), mechanically resistive material, which may be porous or non-porous, that at least partially reduces a pressure differential across the two sides of the barrier by flexing away from the high pressure side (thus lowering the high pressure) and flexing towards the low pressure side (thus raising the low pressure). Note that a resistive coupling formed of semi-rigid material must exhibit sufficient mechanical resistivity such that enough energy is expended by flexing the resistive barrier to damp a standing wave when the wave exerts a pressure differential across the barrier. For example, a resistive coupling could be formed using this technique by a fashioning a barrier from such materials as a closed-cell, non-rigid foam or slightly flexible plastics.

Finally, in various embodiments the resistive coupling may be formed using both of these techniques. For example, a slightly flexible fine-screened mesh could be used which flexes under a high pressure differential (thus expending some energy and damping the wave) and also resistively permits air to flow across the barrier (thus further damping the wave).

An actual enclosure constructed of 0.5" MDF, having dimensions as shown in FIG. 4, and having twelve holes each having a circular cross-section with a diameter of 0.12" produced a frequency response depicted as trace C in FIG. 2. Note that trace C does not have any aberrant characteristics in the frequency response similar to the aberrations at points X and Y in traces A and B, respectively. In other separate embodiments, the holes across the barrier need not be circular in cross-section, but could be square, rectangular, or of another cross-sectional shape.

A number of embodiments of the invention have been described. Nevertheless, it will be understood that various modifications may be made without departing from the spirit and scope of the invention. For example, many geometries of barriers other than the barriers shown in FIGS. 3 and 4 may be designed in order to lower the frequency of standing waves. Barriers may also be placed in other locations within the enclosure to increase the effective length of other dimensions (e.g., the height, width) in order to reduce the amplitude and/or frequency of standing waves other than the lowest frequency standing wave. Similarly, enclosures may be designed with multiple barriers targeted at reducing the amplitude and/or frequency of several standing waves. While the enclosures described above are targeted at reducing the lowest frequency standing waves where the driver is a woofer, the techniques described equally apply to other enclosures for driver units (e.g., tweeters, mid-ranges) radiating higher frequencies where the enclosures are of a form that generate strong internal waves. Other enclosures besides a rectangular enclosure depicted in FIGS. 1, 3, 4, and 5 are also possible. For example the enclosure may have a circular, trapezoidal, triangular, or other shaped longitudinal cross-section.

It is evident that those skilled in the art may make numerous modifications of the departures from the specific apparatus and techniques disclosed herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. A loudspeaker enclosure for reducing standing waves occurring at one or more frequencies, wherein the enclosure has an inner surface defining a cavity, the enclosure comprising:

a first end;

a second end;

a first sidewall;

an internal barrier having a first side and a second side attached to the inner surface of the enclosure along the first sidewall of the enclosure, partially extending into the cavity of the enclosure and extending from the first end of the enclosure to the second end of the enclosure, wherein the internal barrier forms a resistive coupling between the first and second sides.

2. The loudspeaker enclosure of claim 1, wherein the barrier includes at least one hole disposed between the first and second side.

3. The loudspeaker enclosure of claim 2, wherein at least one hole is filled with damping material.

4. The loudspeaker enclosure of claim 3, wherein the damping material comprises foam.

5. The loudspeaker enclosure of claim 1, wherein the internal barrier forming a resistive coupling comprises a barrier formed of rigid, open-cell foam.

6. The loudspeaker enclosure of claim 1, wherein the internal barrier forming a resistive coupling comprises a barrier formed of material of sufficient flexibility such that is may flex under normal play operations.

7. The loudspeaker enclosure of claim 6, wherein the internal barrier has a plurality of holes formed across its first and second side.

8. The loudspeaker enclosure of claim 2, wherein the hole has a non-circular cross-section.

9. The loudspeaker enclosure of claim 1, wherein the barrier forming a resistive coupling comprises a barrier formed of mesh.

10. The loudspeaker of claim 1, further comprising:

a plurality of barriers, each barrier having a first side and a second side and attached to the inner surface of the enclosure, wherein each barrier is configured to form a resistive coupling between its first and second side and is positioned such that a standing wave at a given frequency would create a pressure differential across two sides of the barrier if the barrier was not configured to form a resistive coupling.

11. An apparatus for reducing standing waves in a loudspeaker, the apparatus comprising:

an enclosure having a first end, a second end and a first sidewall, wherein the enclosure defines a channel; and a resistive coupling attached to the enclosure along the first sidewall of the enclosure and located within the channel, the resistive coupling extending from the first end of the enclosure to the second end of the enclosure and having a first substantially planar surface and a second substantially planar surface which is substantially parallel to the first substantially planar surface.

12. The apparatus of claim 11 wherein the resistive coupling comprises a rigid, porous foam material.

13. The apparatus of claim 11, wherein the resistive coupling comprises a flexible, non-porous material.

14. The apparatus of claim 11, wherein the resistive coupling includes a plurality of holes disposed between the first and second substantially planar surfaces.

15. The apparatus of claim 11, wherein the resistive coupling is positioned at a location which reduces a pressure differential created by a standing wave across the first and second substantially planar surfaces.

16. The apparatus of claim 11 wherein the resistive coupling further comprises a third substantially planar surface, wherein the third substantially planar surface is substantially perpendicular to the first and second substantially planar surfaces of the resistive coupling.

17. The apparatus of claim 11 wherein the channel has a cross-sectional shape perpendicular to the length of the enclosure between the first and second end, and wherein the cross-sectional shape is annular.

18. The apparatus of claim 11 wherein the enclosure further comprises a second sidewall, a third sidewall and a fourth sidewall.

19. The apparatus of claim 18 wherein the channel has a cross-sectional shape perpendicular to the length of the enclosure between the first and second end, and wherein the cross-sectional shape is rectangular.

20. The apparatus of claim 11 wherein the enclosure further includes an opening which is open to a medium of transmission.

21. The apparatus of claim 14, wherein one or more of the plurality of holes is filled with damping material.

22. The apparatus of claim 21, wherein the damping material comprises foam.

23. The apparatus of claim 11, wherein the resistive coupling comprises a material of sufficient rigidity to maintain its shape during normal play operations and of sufficient porosity to partially reduce a pressure differential that occurs across the first and second substantially planar surfaces.

24. The apparatus of claim 11, wherein the resistive coupling comprises a material of sufficient flexibility to flex during normal play operations such that the resistive coupling at least partially reduces a pressure differential across the first and second substantially planar surfaces by flexing away from a high pressure and toward a low pressure.

25. A method for reducing standing waves in the frequency response of a loudspeaker having a driver at least partially enclosed by an enclosure having internal dimensions and external dimensions, the method comprising:

increasing the effective length of at least one internal dimension of the enclosure without changing the external dimensions of the enclosure; and forming a resistive coupling between two ends of a standing wave by providing a barrier comprised of a flexible material capable of resistively flexing during normal play operations.

26. The method of claim 25, wherein increasing the effective length of at least one internal dimension includes providing a barrier within the enclosure.

27. The method of claim 25, wherein forming a resistive coupling between two ends of a standing wave includes providing at least one hole in the resistive coupling.

28. The method of claim 27, wherein forming a resistive coupling between two ends of a standing wave further includes filling the at least one hole with damping material.

29. The method of claim 25, wherein forming a resistive coupling comprises providing a barrier comprised of material having sufficient porosity to cause viscous damping when air is allowed to pass through the barrier.

30. The method of claim 25 wherein forming a resistive coupling comprises providing a barrier comprised of open-celled foam material.

31. The method of claim 25, wherein forming a resistive coupling comprises providing a barrier comprised of closed cell, semi-rigid foam.

32. The method of claim 25, wherein forming a resistive coupling comprises providing a barrier comprised of fine-screen mesh.

33. The method of claim 25, wherein forming a resistive coupling comprises providing a barrier comprised of flexible plastic.

* * * * *